US012442372B2

(12) United States Patent
Inagaki et al.

(10) Patent No.: US 12,442,372 B2
(45) Date of Patent: Oct. 14, 2025

(54) CO-ROTATING SCROLL COMPRESSOR

(71) Applicant: KABUSHIKI KAISHA TOYOTA JIDOSHOKKI, Aichi (JP)

(72) Inventors: Yosuke Inagaki, Kariya (JP); Kazunari Honda, Kariya (JP); Yuji Hashimoto, Kariya (JP); Hiroyuki Kobayashi, Kariya (JP); Akito Sugahara, Kariya (JP); Keishiro Muto, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 18/850,613

(22) PCT Filed: Feb. 21, 2023

(86) PCT No.: PCT/JP2023/006192
§ 371 (c)(1),
(2) Date: Sep. 25, 2024

(87) PCT Pub. No.: WO2023/189018
PCT Pub. Date: Oct. 5, 2023

(65) Prior Publication Data

US 2025/0207589 A1 Jun. 26, 2025

(30) Foreign Application Priority Data

Mar. 31, 2022 (JP) ..... 2022-058155

(51) Int. Cl.
*F04C 18/02* (2006.01)
*F04C 29/00* (2006.01)
*F04C 29/12* (2006.01)

(52) U.S. Cl.
CPC ..... *F04C 18/023* (2013.01); *F04C 29/0057* (2013.01); *F04C 29/12* (2013.01); *F04C 2240/30* (2013.01)

(58) Field of Classification Search
CPC .... F04C 18/023; F04C 29/0057; F04C 29/12; F04C 2240/30
See application file for complete search history.

(56) References Cited

U.S. PATENT DOCUMENTS

2002/0150485 A1* 10/2002 Mori ..... F01C 17/063 417/410.5
2002/0182094 A1 12/2002 Mori et al.
2015/0056086 A1* 2/2015 Yano ..... F04C 23/02 417/410.5

FOREIGN PATENT DOCUMENTS

JP 07-229480 A 8/1995
JP 2002-310073 A 10/2002
(Continued)

OTHER PUBLICATIONS

International Search Report issued in International Patent Application No. PCT/JP2023/006192, dated May 9, 2023, along with an English translation thereof.

*Primary Examiner* — J. Todd Newton
(74) *Attorney, Agent, or Firm* — Greenblum & Bernstein, P.L.C.

(57) ABSTRACT

Provided is a co-rotating scroll compressor capable of suitably cooling an inverter circuit and preventing short circuits in the inverter circuit caused by condensation water. In the compressor of the present disclosure, a driving scroll and a driven scroll are disposed in a suction chamber. The driving scroll is driven rotatably around a drive shaft center axis, and the driven scroll follows rotatably around a driven shaft center axis. In an inverter chamber, an inverter circuit is accommodated. In a driving end plate of the driving scroll, a suction port is formed. The suction port allows a compression chamber to suction refrigerant gas from the suction chamber. The suction port faces a partition wall.

7 Claims, 9 Drawing Sheets

(56) References Cited

FOREIGN PATENT DOCUMENTS

| | | | |
|---|---|---|---|
| JP | 2002-357188 | A | 12/2002 |
| JP | 2007-292044 | A | 11/2007 |
| JP | 2011-058388 | A | 3/2011 |

* cited by examiner

CO-ROTATING SCROLL COMPRESSOR

TECHNICAL FIELD

The present disclosure relates to a co-rotating scroll compressor.

BACKGROUND ART

Patent Literature 1 discloses a conventional scroll compressor. This scroll compressor includes a driving mechanism, an inverter circuit, a fixed scroll, a driven mechanism, a driven scroll, and a housing.

The housing has a suction chamber into which low-pressure refrigerant gas is suctioned from an outside by an inlet communication port, an inverter chamber in which an inverter circuit is accommodated, and a partition wall that separates the suction chamber and the inverter chamber from each other. The driving mechanism has a stator fixed in the suction chamber and is supplied with power by the inverter circuit, a rotor rotatably provided in the stator, and a drive shaft fixed to the rotor.

The fixed scroll is fixed in the housing. The driven scroll is provided in the housing and is connected to the drive shaft. The driven scroll is rotatable around the drive shaft center axis with the drive shaft. The driven mechanism couples the driven scroll and the housing while preventing rotation of the driven scroll.

In more detail, the fixed scroll has a fixed end plate, a fixed circumferential wall, and a fixed spiral body. The fixed end plate extends orthogonally to a drive shaft center axis. The fixed circumferential wall protrudes toward the driven scroll from the fixed end plate parallelly to the drive shaft center axis and forms a tubular shape around the drive shaft center axis. The fixed spiral body protrudes toward the driven scroll from the fixed end plate within the fixed circumferential wall parallelly to the drive shaft center axis and forms a spiral shape around the drive shaft center axis.

The driven scroll has the driven end plate and the driven spiral body. The driven end plate extends orthogonally to the drive shaft center axis. The driven spiral body protrudes toward the fixed scroll from the driven end plate parallelly to the drive shaft center axis and forms a spiral shape around the drive shaft center axis.

In this scroll compressor, the fixed scroll and the driven scroll form a compression chamber by making the fixed spiral body and the driven spiral body face each other. Then, the driven scroll rotates around the drive shaft center axis, and thereby a volume of the compression chamber changes. Accordingly, the refrigerant gas in the suction chamber is suctioned into the compression chamber and is compressed. Then, the refrigerant gas compressed in the compression chamber is discharged to the outside. Furthermore, since in this scroll compressor, the partition wall is cooled by the refrigerant gas that is suctioned into the suction chamber, the inverter circuit in the inverter chamber is cooled through this partition wall.

CITATION LIST

Patent Literature

Patent Literature 1: Japanese Patent Laid-Open No. 2011-58388

SUMMARY OF INVENTION

Technical Problem

However, in the above-described conventional scroll compressor, concerning the temperature of the partition wall, variation increases from place to place. In other words, since the refrigerant gas immediately after being suctioned from the inlet communication port has a low temperature, a position in a vicinity of the inlet communication port in the partition wall tends to have a low temperature. On the other hand, a position away from the inlet communication port in the partition wall is easily heated by the inverter circuit that has generated heat during operation, and therefore tends to have a high temperature. In this way, since the variation in the temperature according to the place increases with respect to the partition wall, it is difficult to suitably cool the inverter circuit through the partition wall in this scroll compressor.

Furthermore, in this scroll compressor, in the position in the vicinity of the inlet communication port in the partition wall, the temperature difference from the inverter chamber tends to be large. Accordingly, condensation water is easily formed in the inverter chamber, and short circuits are likely to occur in the inverter circuit due to the condensation water.

The present disclosure is made in view of the above-described conventional circumstances, and an object of the present disclosure is to provide a co-rotating scroll compressor capable of suitably cooling an inverter circuit, and capable of preventing short circuits in the inverter circuit due to condensation water.

Solution to Problem

A co-rotating scroll compressor of the present disclosure comprises a driving mechanism, an inverter circuit, a driving scroll, a driven mechanism, a driven scroll, and a housing, the housing having a suction chamber into which a fluid is suctioned from an outside, an inverter chamber in which the inverter circuit is accommodated, and a partition wall that separates the suction chamber and the inverter chamber from each other, the driving scroll being disposed in the suction chamber and being driven rotatably around a drive shaft center axis by the driving mechanism, the driven scroll being disposed in the suction chamber and following rotatably around a driven shaft center axis that is eccentric with respect to the driving scroll by the driving scroll and the driven mechanism, the driving scroll having a driving end plate extending to cross the drive shaft center axis, and a driving spiral body protruding toward the driven scroll from the driving end plate and forming a spiral shape, the driven scroll having a driven end plate extending to cross the driven shaft center axis, and a driven spiral body protruding toward the driving scroll from the driven end plate and forming a spiral shape, and the driving scroll and the driven scroll forming a compression chamber by the driving spiral body and the driven spiral body facing each other, and reducing a volume of the compression chamber by the rotational driving and the rotational following, wherein a suction port that allows the compression chamber to suction the fluid from the suction chamber is formed in the driving end plate or the driven end plate, and the suction port faces the partition wall.

In the co-rotating scroll compressor of the present disclosure (hereinafter, simply referred to as a compressor), the driving scroll is driven rotatably around the drive shaft center axis, and the driven scroll follows rotatably around the driven shaft center axis, in the suction chamber. Therefore, the suction port formed in the driving end plate or the driven end plate rotates with rotation of the driving scroll or the driven scroll. Here, the suction port faces the partition wall. Therefore, the fluid in the suction chamber is suctioned into the compression chamber through the rotating suction port from between the partition wall and the driving end plate or the driven end plate in which the suction port is formed.

In this way, in this compressor, the fluid is suctioned into the suction port, in turn, into the compression chamber while being stirred in the suction chamber. Consequently, the partition wall is easily cooled uniformly as a whole by the fluid. Consequently, the variation in the temperature of the partition wall as a whole is reduced. Consequently, the inverter circuit can be suitably cooled through the partition wall. Furthermore, in this compressor, the temperature difference between the partition wall and the inverter chamber can also be reduced, so that condensation water is even less likely to form in the inverter chamber.

Consequently, according to the co-rotating scroll compressor of the present disclosure, the inverter circuit can be suitably cooled, and short circuits in the inverter circuit caused by condensation water can be prevented.

The driving mechanism can be disposed in the suction chamber. Furthermore, the housing can have an inlet communication port that connects the outside to the suction chamber. Furthermore, the suction port can be formed in the driving end plate. The inlet communication port is disposed further away from the driving end plate than the driven end plate. In this case, the fluid suctioned into the suction chamber from the inlet communication port can suitably cool the driving mechanism in a process of the flowing toward the driving end plate, in turn, toward the suction port.

The driving end plate preferably has a guide portion that guides the fluid to the suction port while stirring the fluid. In this case, since the fluid can be even more effectively stirred in the suction chamber by the guide portion, the variation in the temperature of the partition wall can be further reduced. Consequently, the inverter circuit can be more suitably cooled through the partition wall. Furthermore, in this compressor, condensation water is even less likely to form in the inverter chamber.

The inverter circuit can have a switching element. The suction port can be a plurality of suction ports. The respective suction ports preferably sequentially overlap the switching element in an axial direction of the drive shaft via the partition wall, with the rotational driving of the driving scroll and the rotational following of the driven scroll.

Since the switching element reaches a high temperature during operation of the compressor, a cooling requirement is high in the inverter circuit. In this regard, in this compressor, the respective suction ports sequentially overlap with the switching element in the axial direction of the drive shaft via the partition wall, with the rotational driving of the driving scroll and the rotational following of the driven scroll. Accordingly, although a position facing the switching element in the partition wall easily reaches a high temperature locally due to heat of the switching element during operation, the entire partition wall including the position like this is easily cooled uniformly by the fluid suctioned into the respective suction ports, in this compressor. As a result of this, in this compressor, the switching element can be suitably cooled by the low-temperature partition wall.

Furthermore, the housing can have an inlet communication port that connects the outside to the suction chamber. The inverter circuit can have a switching element. The compression chamber can have a first compression chamber, and a second compression chamber separated from the first compression chamber. The number of turns in a circumferential direction in the driving spiral body, and the number of turns in the circumferential direction in the driven spiral body are equal. A phase of the driving scroll and the driven scroll in which respective volumes of the first compression chamber and the second compression chamber become maximum can be a first phase. The suction port is also preferably located on an opposite side of the inlet communication port in a radial direction across the switching element, in the first phase.

When the number of turns in the circumferential direction of the driving spiral body, and the number of turns in the circumferential direction of the driven spiral body are equal, the volumes of the first compression chamber and the second compression chamber become maximum at same timing, and at this time, the fluid is confined in the first compression chamber and the second compression chamber. Therefore, when the phase of the driving scroll and the driven scroll is the first phase, a flow rate of the fluid suctioned into the suction port from an inside of the suction chamber increases. Since in this compressor, in the first phase, the suction port is located on the opposite side of the inlet communication port in the radial direction across the switching element, the suction port and the inlet communication port are sufficiently away from each other in the radial direction, in the first phase. Since in the first phase, a lot of fluid is suctioned into the suction port as described above, the partition wall is easily cooled more uniformly and sufficiently as a whole including the position facing the switching element. As a result of this, in this compressor, the entire inverter circuit including the switching element can be suitably cooled through the partition wall.

Furthermore, the housing can have an inlet communication port that connects the outside to the suction chamber. The inverter circuit can have a switching element. The compression chamber can have a first compression chamber, and a second compression chamber separated from the first compression chamber. The number of turns in the circumferential direction in the driving spiral body, and the number of turns in the circumferential direction in the driven spiral body are different. A phase of the driving scroll and the driven scroll in which a volume of the first compression chamber becomes maximum can be a second phase. A phase of the driving scroll and the driven scroll in which a volume of the second compression chamber becomes maximum can be a third phase. The suction port is also preferably located on an opposite side of the inlet communication port in a radial direction across the switching element, between the second phase and the third phase.

When the number of turns in the circumferential direction of the driving spiral body, and the number of turns in the circumferential direction of the driven spiral body are different, a lag occurs between the timing at which the volume of the first compression chamber becomes maximum, and the timing at which the volume of the second compression chamber becomes maximum. Therefore, a lag occurs between the timing at which confinement of the fluid occurs in the first compression chamber, and the timing at which confinement of the fluid occurs in the second compression chamber. Here, between the second phase in which the volume of the first compression chamber becomes maximum, and the third phase in which the volume of the second compression chamber becomes maximum, the flow rate of the fluid suctioned into the suction port from the inside of the suction chamber increases. Furthermore, since in this compressor, the suction port is located on the opposite side of the inlet communication port in the radial direction across the switching element between the second phase and the third phase, the suction port and the inlet communication port are sufficiently away from each other in the radial direction between the second phase and the third phase. Therefore, in this compressor, the partition wall is also easily cooled more uniformly and sufficiently as a whole including the position facing the switching element, so that the entire inverter circuit including the switching element can be suitably cooled through the partition wall.

Advantageous Effects of Invention

According to the co-rotating scroll compressor of the present disclosure, the inverter circuit can be suitably cooled, and short circuits in the inverter circuit caused by condensation water can be prevented.

DESCRIPTION OF EMBODIMENTS

Hereinafter, embodiments 1 to 4 that embody the present disclosure will be described with reference to the drawings.

Embodiment 1

Figure 1:
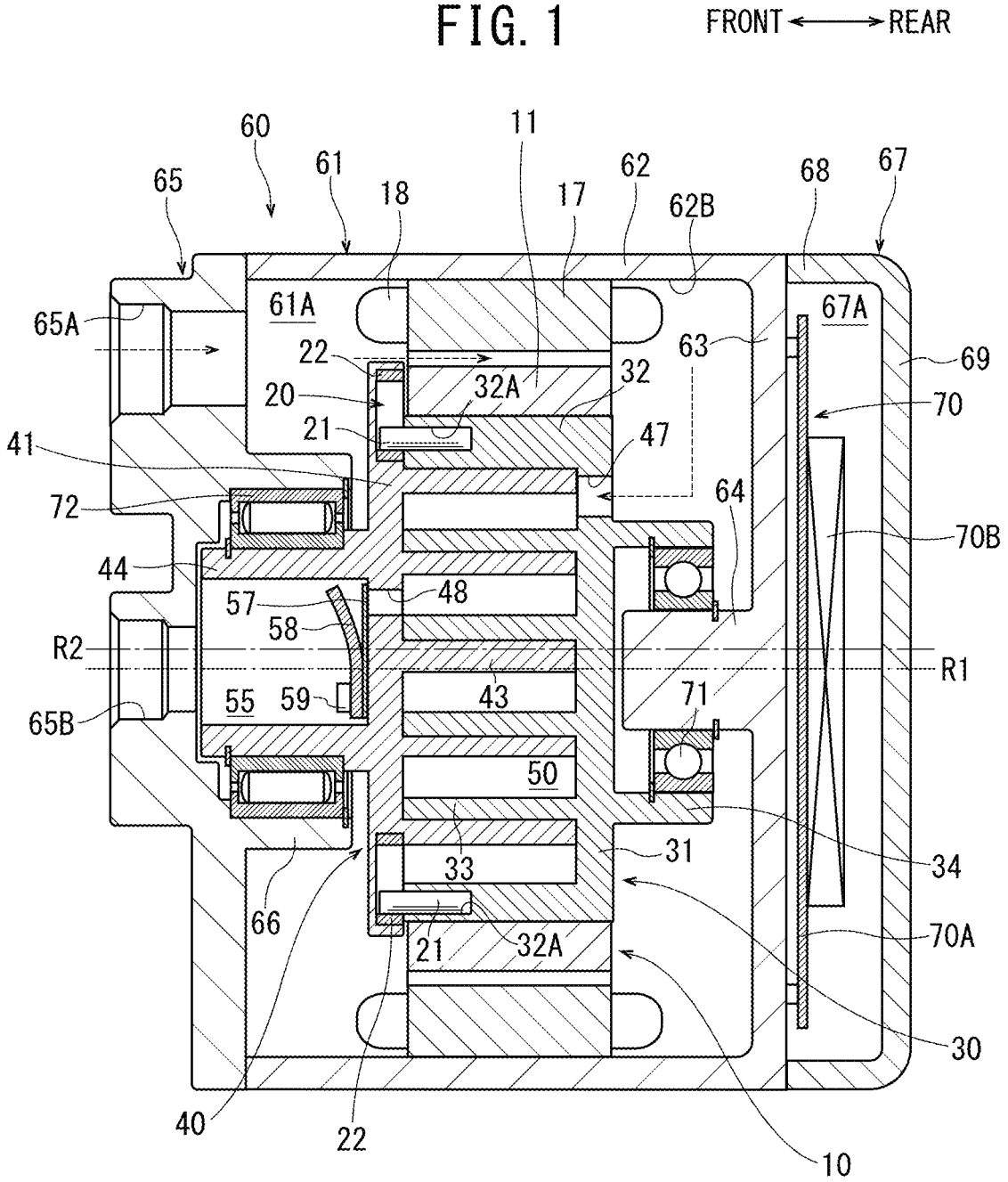
FIG. 1 is a sectional view of a co-rotating scroll compressor of embodiment 1.

As shown in FIG. 1, a compressor of embodiment 1 comprises a housing 60, an electric motor 10, an inverter circuit 70, a driving scroll 30, a driven scroll 40, and a driven mechanism 20. The electric motor 10 is an example of a "driving mechanism" in the present disclosure. This compressor is mounted on a vehicle not shown and constitutes an air conditioning apparatus for a vehicle.

In the present embodiment, a front-rear direction of the compressor is defined by a solid line arrow shown in FIG. 1. Note that the front-rear direction is an example for convenience of explanation, and a posture of the compressor can change as appropriate according to a vehicle on which the compressor is mounted.

The housing 60 is formed of a housing body 61, a cover 65, and an inverter case 67. The housing body 61 is a bottomed cylindrical member having a first outer circumferential wall 62 and a first bottom wall 63. The first bottom wall 63 is an example of a "partition wall" in the present disclosure. The first outer circumferential wall 62 forms a cylindrical shape centered on a drive shaft center axis R1. The drive shaft center axis R1 is parallel to the front-rear direction. Furthermore, the first outer circumferential wall 62 has an inner peripheral surface 62B. The first bottom wall 63 is located at a rear end of the housing body 61. The first bottom wall 63 extends in a substantially circular flat plate shape orthogonally to the drive shaft center axis R1.

An outer peripheral edge of the first bottom wall 63 is connected to a rear end of the first outer circumferential wall 62. In an inner surface center of the first bottom wall 63, a columnar bearing support 64 that protrudes frontward is provided to protrude. An inner race of a bearing 71 is fitted into the bearing support 64.

The cover 65 is disposed in front of the housing body 61. The cover 65 extends in a substantially circular flat plate shape orthogonally to the drive shaft center axis R1. The cover 65 is fastened to the first outer circumferential wall 62 by a bolt not illustrated in a state where an outer peripheral edge thereof abuts on a front end of the first outer circumferential wall 62 of the housing body 61. Accordingly, the cover 65 closes the housing body 61 from a front. Thus, a suction chamber 61A is formed in the housing body 61.

At the center of the inner surface of the cover 65, a cylindrical bearing support 66 centered on a driven shaft center axis R2 is provided to protrude. The driven shaft center axis R2 extends parallel to the drive shaft center axis R1 while being eccentric with respect to the drive shaft center axis R1. In other words, the driven shaft center axis R2 is also parallel to the front-rear direction. An outer race of a needle bearing 72 is fitted into the bearing support 66.

An inlet communication port 65A and a discharge communication port 65B are formed in the cover 65. The inlet communication port 65A is located between the outer peripheral edge and the bearing support 66 in the cover 65, and extends through the cover 65 in a direction parallel to the drive shaft center axis R1. The inlet communication port 65A connects the suction chamber 61A to the outside of the compressor. Piping is connected to the inlet communication port 65A. Accordingly, low-temperature and low-pressure refrigerant gas passing through an evaporator through the piping is suctioned into the suction chamber 61A. The refrigerant gas is an example of a "fluid" in the present disclosure.

The discharge communication port 65B is located in a center of the cover 65 and extends through the cover 65 in a direction parallel to the drive shaft center axis R1. The discharge communication port 65B communicates with a discharge chamber 55 described later. Piping is connected to the discharge communication port 65B and allows the refrigerant gas discharged into the discharge chamber 55 to flow toward a condenser. Note that illustration of the piping, the evaporator, and the condenser is omitted.

The inverter case 67 is disposed behind the housing body 61. The inverter case 67 is a bottomed cylindrical member having a second outer circumferential wall 68 and a second bottom wall 69. The second outer circumferential wall 68 forms a cylindrical shape centered around the drive shaft center axis R1. The second bottom wall 69 is located at a rear end of the inverter case 67. The second bottom wall 69 extends in a substantially circular flat plate shape orthogonally to the drive shaft center axis R1. An outer peripheral edge of the second bottom wall 69 is connected to a rear end of the second outer circumferential wall 68.

The inverter case 67 is fastened to the first bottom wall 63 by bolts not shown in a state in which a front end of the second outer circumferential wall 68 abuts on a rear surface of the first bottom wall 63. Accordingly, the inverter case 67 forms an inverter chamber 67A between the inverter case 67 and the first bottom wall 63. The inverter chamber 67A is adjacent to the suction chamber 61A behind the suction chamber 61A. Furthermore, the inverter chamber 67A is separated from the suction chamber 61A by the first bottom wall 63. Note that though not shown, a connector portion is provided on the inverter case 67.

The electric motor 10 is accommodated in the suction chamber 61A. Accordingly, the suction chamber 61A also serves as a motor chamber that accommodates the electric motor 10. The electric motor 10 is formed of a stator 17, and a rotor 11.

The stator 17 has a cylindrical shape centered around the drive shaft center axis R1, and has a winding 18. The stator 17 is fitted into the inner peripheral surface 62B of the first outer circumferential wall 62 of the housing body 61, and is thereby fixed to the housing body 61, in turn, to the housing 60.

The rotor 11 forms a cylindrical shape around the drive shaft center axis R1 and is disposed in the stator 17. Although detailed illustration is omitted, the rotor 11 is formed of a plurality of permanent magnets corresponding to the stator 17, and a laminated steel sheet that fixes the respective permanent magnets.

The inverter circuit 70 is accommodated in the inverter chamber 67A. The inverter circuit 70 is formed of a circuit board 70A, a switching element 70B provided on the circuit board 70A, and the like. In the inverter circuit 70, the circuit board 70A is fixed to a rear surface of the first bottom wall 63 by bolts not shown. The inverter circuit 70 is electrically connected to a battery (not shown) of a vehicle through a connector provided in the inverter case. Furthermore, the inverter circuit 70 is electrically connected to the stator 17 through an airtight passage (not shown) provided in the first bottom wall 63. Accordingly, the inverter circuit 70 performs electric power supply to the stator 17 while converting a DC current supplied from the battery into an AC current in the switching element 70B.

The driving scroll 30 has a driving end plate 31, a driving circumferential wall 32, and a driving spiral body 33. The driving end plate 31 extends in a substantially disk shape orthogonally to the drive shaft center axis R1. In a center of a rear surface of the driving end plate 31, a first boss 34 protruding toward the first bottom wall 63 is formed. The first boss 34 forms a cylindrical shape centered on the drive shaft center axis R1.

Figure 2:
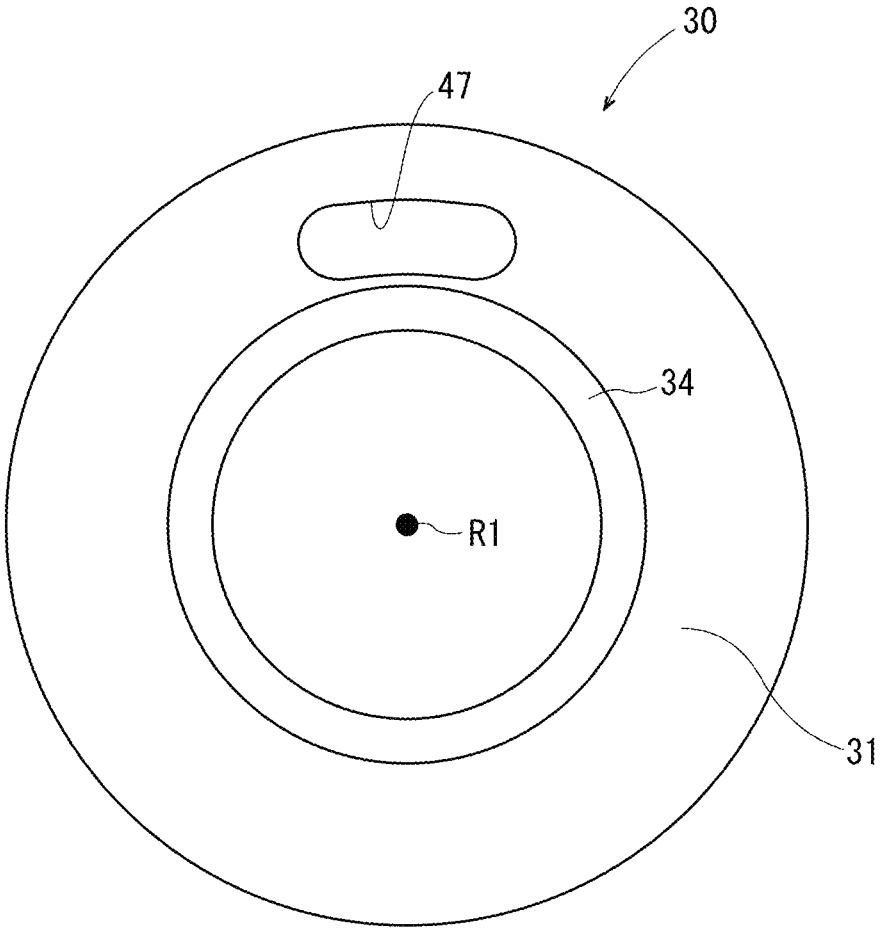
FIG. 2 is a rear view of a driving end plate according to the co-rotating scroll compressor of embodiment 1.

Furthermore, in the driving end plate 31, a suction port 47 is formed. As shown in FIG. 2, the suction port 47 is disposed in a position that is closer to an outer periphery than the first boss 34. Thereby, in a radial direction of the driving end plate 31, the suction port 47 is further away from the drive shaft center axis R1 than the first boss 34. The suction port 47 is formed into a substantially elliptical shape extending in a circumferential direction of the driving end plate 31. As shown in FIG. 1, the suction port 47 extends through the driving end plate 31 in a direction of the drive shaft center axis R1, that is, the front-rear direction. Note that the shape of the suction ports 47 and the number of the suction ports 47 can be appropriately designed.

The driving circumferential wall 32 is formed integrally with the driving end plate 31, and extends frontward from an outer peripheral edge of the driving end plate 31, that is, toward the driven scroll 40 parallelly to the drive shaft center axis R1. The driving circumferential wall 32 forms a substantially cylindrical shape centered around the drive shaft center axis R1. Furthermore, four fixing holes 32A are formed in a front end of the driving circumferential wall 32. Note that in FIG. 1, two of the four fixing holes 32A are shown.

The driving spiral body 33 is located inside of the driving circumferential wall 32. The driving spiral body 33 extends frontward from the driving end plate 31 parallelly to the drive shaft center axis R1. Although detailed illustration is omitted, the driving spiral body 33 extends in a spiral shape around the drive shaft center axis R1 toward the outer periphery from a spiral center while having the spiral center close to a center of the driving end plate 31. The driving spiral body 33 is connected to the driving circumferential wall 32 at an end portion close to the outer periphery in the spiral.

The driven scroll 40 has a driven end plate 41 and a driven spiral body 43. The driven end plate 41 extends in a substantially disk shape orthogonally to the driven shaft center axis R2. At the center of a front surface of the driven end plate 41, a second boss 44 protruding toward the cover 65 is formed. The second boss 44 forms a cylindrical shape centered around the driven shaft center axis R2.

A discharge port 48 is formed in the driven end plate 41. The discharge port 48 is disposed in a position inside the second boss 44 in the driven end plate 41 and extends through the driven end plate 41 in the front-rear direction.

Furthermore, in the second boss 44, a discharge reed valve 57 and a retainer 58 are fixed to the driven end plate 41 by a fixing bolt 59. Accordingly, the discharge reed valve 57 can open and close the discharge port 48, and the retainer 58 can adjust an opening degree of the discharge reed valve 57.

The driven spiral body 43 extends rearward, that is, toward the driving scroll 30 from the driven end plate 41 parallelly to the driven shaft center axis R2. Although detailed illustration is omitted, the driven spiral body 43 extends in a spiral shape around the driven shaft center axis R2 toward the outer periphery from a spiral center while having the spiral center close to the center of the driven end plate 41.

The driven mechanism 20 is formed of four rotation prevention pins 21 and four rings 22. Note that the numbers of the rotation prevention pins 21 and rings 22 can be appropriately designed as long as they are more than or equal to three. Furthermore, in FIG. 1, two of the respective rotation prevention pins 21 and two of the respective rings 22 are shown.

The respective rotation prevention pins 21 are respectively inserted through and fixed to the respective fixing holes 32A of the driving circumferential wall 32. Thereby, the respective rotation prevention pins 21 are fixed to the driving circumferential wall 32 in a state of being protruded frontward from the driving circumferential wall 32.

The respective rings 22 are provided in the driven end plate 41 to face the respective rotation prevention pins 21. The respective rings 22 are each fitted to a circular bottomed hole provided to be recessed in the driven end plate 41.

In this compressor, the driving scroll 30 and the driven scroll 40 are both disposed in the suction chamber 61A. The driving scroll 30 is integrated with the rotor 11 by the driving circumferential wall 32 being fixed to an inner peripheral surface of the rotor 11. Furthermore, in the driving scroll 30, the outer race of the bearing 71 is internally fitted in the first boss 34. Thereby, the driving scroll 30 is supported by the housing body 61 rotatably around the drive shaft center axis R1. Here, in this compressor, the driving scroll 30 is supported by the housing body 61, in turn, by the housing 60 in a so-called cantilever state.

Furthermore, in the driving scroll 30, the driving end plate 31 is located rearward in the suction chamber 61A. The driving end plate 31 faces the first bottom wall 63 of the housing body 61 in the direction of the drive shaft center axis R1. Accordingly, the suction port 47 also faces the first bottom wall 63 in the direction of the drive shaft center axis R1.

On the other hand, the driven scroll 40 is disposed in front of the driving scroll 30 in a state in which the driven spiral body 43 is faced to the driving scroll 30. The driving scroll 30 and the driven scroll 40 cause the driving spiral body 33 and the driven spiral body 43 to be meshed with each other inside of the driving circumferential wall 32, and cause the respective rotation prevention pins 21 to enter the respective rings 22. Thus, the driving scroll 30 and the driven scroll 40 are assembled in the front-rear direction.

In the driven scroll 40, an inner race of the needle bearing 72 is externally fitted onto the second boss 44. Accordingly, the driven scroll 40 is supported by the cover 65 rotatably around the driven shaft center axis R2. Here, in this compressor, the driven scroll 40 is also supported by the cover 65, in turn, by the housing 60 in a so-called cantilever state.

Furthermore, the driven scroll 40 is supported by the cover 65, and thereby a space surrounded by an inner peripheral surface of the second boss 44 and sandwiched by the cover 65 and the driven end plate 41 corresponds to the discharge chamber 55.

Furthermore, since in this compressor, the inlet communication port 65A is formed in the cover 65, the inlet communication port 65A is located in front of the suction chamber 61A. Accordingly, the inlet communication port 65A is further away from the driving end plate 31 and the suction port 47 in the direction of the drive shaft center axis R1 than the driven end plate 41.

In this compressor formed as above, the electric motor 10 operates by the inverter circuit 70 performing operation control of the electric motor 10 while supplying electric power to the stator 17. As a result that the rotor 11 thereby rotates, the driving scroll 30 is driven rotatably around the drive shaft center axis R1 in the suction chamber 61A. In other words, the driving scroll 30 and the rotor 11 are integrally driven rotatably. At this time, in the driven mechanism 20, the respective rotation prevention pins 21 cause the respective rings 22 to relatively rotate around the centers of the respective rotation prevention pins 21 while sliding in contact with the inner peripheral surfaces of the respective rings 22. Thus, the driven mechanism 20 transmits torque of the driving scroll 30 to the driven scroll 40.

As a result, the driven scroll 40 follows rotatably around the driven shaft center axis R2 by the driving scroll 30 and the driven mechanism 20. At this time, the driven mechanism 20 restricts the driven scroll 40 from self-rotating. Accordingly, as for the driving scroll 30 and the driven scroll 40, the driven scroll 40 relatively orbits around the drive shaft center axis R1 with respect to the driving scroll 30 by the rotational driving thereof and the rotational following thereof. Accordingly, the driving spiral body 33 and the driven spiral body 43 contact each other to form two compression chambers 50 between them. As the driving scroll 30 is driven rotatably, and the driven scroll 40 follows rotatably, the driving spiral body 33 and the driven spiral body 43 change volumes of the compression chambers 50.

Consequently, the refrigerant gas in the suction chamber 61A is suctioned into the compression chamber 50 by the suction port 47 and is compressed in the compression chamber 50. Then, the refrigerant gas compressed to discharge pressure in the compression chamber 50 is discharged to the discharge chamber 55 from the discharge port 48, and further discharged to a condenser from the discharge communication port 65B. In this way, air-conditioning by air conditioning apparatus for the vehicle is performed.

Here, in this compressor, the driving end plate 31 is located rearward in the suction chamber 61A and faces the first bottom wall 63. Furthermore, since the suction port 47 is formed in the driving end plate 31, the suction port 47 is also located rearward in the suction chamber 61A and faces the first bottom wall 63. Consequently, as the driving scroll 30 is driven rotatably, the suction port 47 rotates around the drive shaft center axis R1 with the driving end plate 31 while facing the first bottom wall 63.

Consequently, as shown by a broken line arrow in FIG. 1, the refrigerant gas in the suction chamber 61A is suctioned into the compression chamber 50 through the suction port 47 rotating around the drive shaft center axis R1 from between the first bottom wall 63 and the driving end plate 31. In other words, the suction port 47 allows the compression chamber 50 to suction the refrigerant gas from the suction chamber 61A while rotating around the drive shaft center axis R1. Thus, in this compressor, the refrigerant gas is suctioned into the suction port 47, in turn, into the compression chamber 50 while being stirred in the suction chamber 61A, more precisely, in the space between the first bottom wall 63 and the driving end plate 31 in the suction chamber 61A.

Consequently, the first bottom wall 63 is easily cooled uniformly as a whole by the refrigerant gas in the suction chamber 61A, and the variation in the temperature of the first bottom wall 63 as a whole is minimized. Consequently, the first bottom wall 63 maintains a suitably low temperature as a whole. In other words, the first bottom wall 63 is not easily subjected to local high temperatures due to the influence of the switching element 70B and the like of the inverter circuit 70 that generates heat during operation or to excessively low temperatures due to the refrigerant gas in the suction chamber 61A.

Accordingly, in this compressor, it is possible to suitably cool the inverter circuit 70 in the inverter chamber 67A through the low-temperature first bottom wall 63. Furthermore, in this compressor, a temperature difference between the first bottom wall 63 and the inverter chamber 67A can be also reduced as much as possible, and therefore it is possible to suitably prevent condensation water from forming in the inverter chamber 67A.

Consequently, according to the compressor of embodiment 1, it is possible to suitably cool the inverter circuit 70 and prevent short circuits in the inverter circuit 70 due to condensation water.

Furthermore, since in this compressor, the refrigerant gas is stirred in the suction chamber 61A, variation in temperature distribution in the suction chamber 61A can be reduced.

Consequently, in this compressor, it is also possible to suitably cool the stator 17 and the rotor 11.

Furthermore, since in this compressor, the inlet communication port 65A is formed in the cover 65, the inlet communication port 65A is in front of and away from the driving end plate 31 and the suction port 47. Consequently, when the refrigerant gas suctioned into the suction chamber 61A by the inlet communication port 65A is suctioned into the suction port 47, the refrigerant gas flows rearward in the suction chamber 61A while flowing between the stator 17 and the rotor 11. In this respect, it is also possible to suitably cool the stator 17 and the rotor 11 in this compressor.

Embodiment 2

Figure 3:
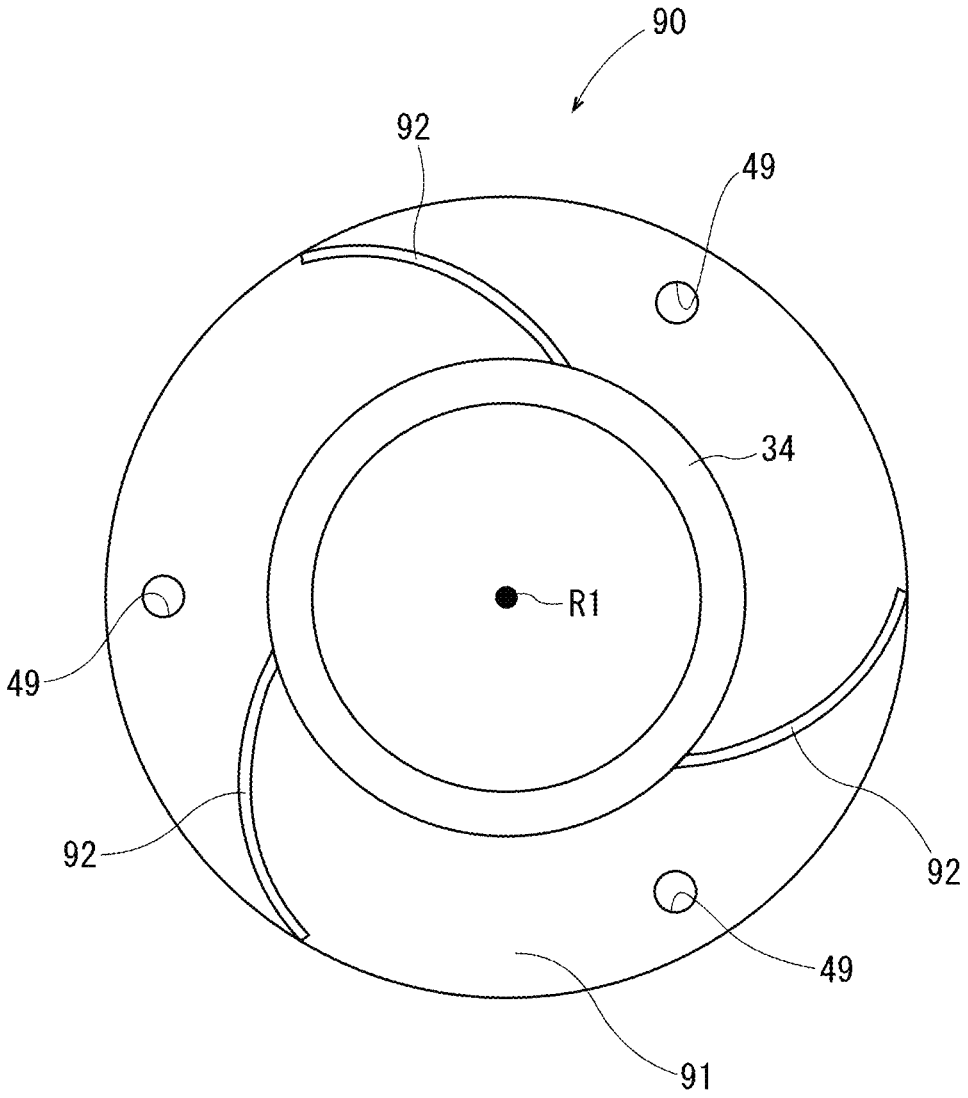
FIG. 3 is a rear view of a driving end plate according to a co-rotating scroll compressor of embodiment 2.

A compressor of embodiment 2 includes a driving scroll 90 shown in FIG. 3 in place of the driving scroll 30. The driving scroll 90 has a driving end plate 91. Furthermore, although not shown, the driving scroll 90 has a driving circumferential wall 32 and a driving spiral body 33 that are the same as those in the driving scroll 30.

The driving end plate 91 extends in a substantially disk-shaped manner orthogonally to the drive shaft center axis R1 similarly to the driving end plate 31. Furthermore, a first boss 34 is also formed at a center of a rear surface of the driving end plate 91 as in the driving end plate 31.

Three suction ports 49 are formed in the driving end plate 91. The respective suction ports 49 are disposed at positions closer to an outer periphery than the first boss 34. Accordingly, the respective suction ports 49 are further away from the drive shaft center axis R1 than the first boss 34 in a radial direction of the driving end plate 91. Furthermore, the respective suction ports 49 are disposed at equal intervals in a circumferential direction of the driving end plate 91. Each of the suction ports 49 forms a circular shape and extends through the driving end plate 91 in a front-rear direction.

Furthermore, the driving end plate 91 has three guide blades 92. Each of the respective guide blades 92 is an example of a "guide portion" in the present disclosure. The respective guide blades 92 are each integrally formed at the driving end plate 91 at positions outside the first boss 34, and protrude rearward in a plate-like shape from the driving end plate 91. Furthermore, the respective guide blades 92 are each disposed between the suction ports 49, and radially extend while curving toward an outer peripheral edge of the driving end plate 91 from positions close to the first boss 34, that is, positions close to the drive shaft center axis R1. Note that shapes and the numbers of the suction ports 49 and the guide blades 92 can be appropriately designed.

Although not shown, the driving scroll 90 is also assembled with the driven scroll 40 and disposed in the suction chamber 61A similarly to the driving scroll 30. Accordingly, the driving end plate 91 and the respective suction ports 49 face the first bottom wall 63 similarly to the driving end plate 31 and the suction port 47 in the compressor of embodiment 1.

Figure 4:
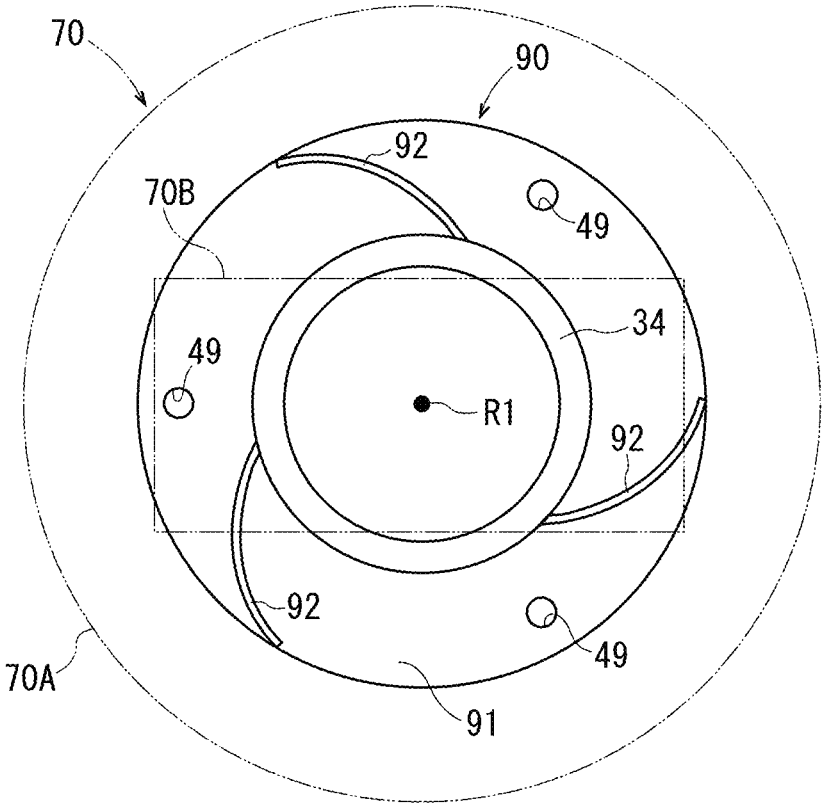
FIG. 4 is a schematic rear view of the driving end plate and an inverter circuit showing a positional relationship of a suction port and a switching element according to the co-rotating scroll compressor of embodiment 2.

Furthermore, as shown in FIG. 4, in this compressor, in a state in which the respective suction ports 49 and the first bottom wall 63 face each other, as the driving scroll 90 is driven rotatably, the respective suction ports 49 sequentially overlap the switching element 70B in a direction of the drive shaft center axis R1 via the first bottom wall 63. Note that in FIG. 4, to facilitate explanation, the inverter circuit 70 including the switching element 70B is shown by a virtual line. Other components in this compressor are the same as those in the compressor of embodiment 1, and the same components are assigned with the same reference signs to omit detailed description concerning the components.

In this compressor, with the rotational driving of the driving scroll 90, the respective suction ports 49 allows the compression chamber 50 to suction the refrigerant gas from the suction chamber 61A while rotating around the drive shaft center axis R1. At this time, the respective guide blades 92 formed at the driving end plate 91 also rotate around the drive shaft center axis R1 with the driving end plate 91. Accordingly, the respective guide blades 92 guide the refrigerant gas to the respective suction ports 49 while stirring the refrigerant gas. Accordingly, since the refrigerant gas is stirred more between the first bottom wall 63 and the driving end plate 91 in this compressor, the first bottom wall 63 is easily cooled more uniformly by the refrigerant gas. Consequently, in this compressor, the inverter circuit 70 in the inverter chamber 67A can be more suitably cooled through the low-temperature first bottom wall 63, and condensation water can be more suitably prevented from forming in the inverter chamber 67A.

In particular, in this compressor, as the driving scroll 90 is driven rotatably, the respective suction ports 49 sequentially overlap with the switching element 70B in the direction of the drive shaft center axis R1 via the first bottom wall 63. Accordingly, while the position of the first bottom wall 63, which faces the switching element 70B in the inverter chamber 67A tends to have high temperature locally due to the heat of the switching element 70B during operation, the respective suction ports 49 sequentially face the position like this in the suction chamber 61A. Accordingly, in this compressor, the entire bottom wall 63 including the position facing the switching element 70B in the first bottom wall 63 is easily cooled uniformly by the refrigerant gas suctioned into the respective suction ports 49. As a result of this, in this compressor, it is possible to suitably cool the switching element 70B by the low-temperature first bottom wall 63. The other operations in this compressor are the same as those in the compressor of embodiment 1.

Embodiment 3

Figure 5:
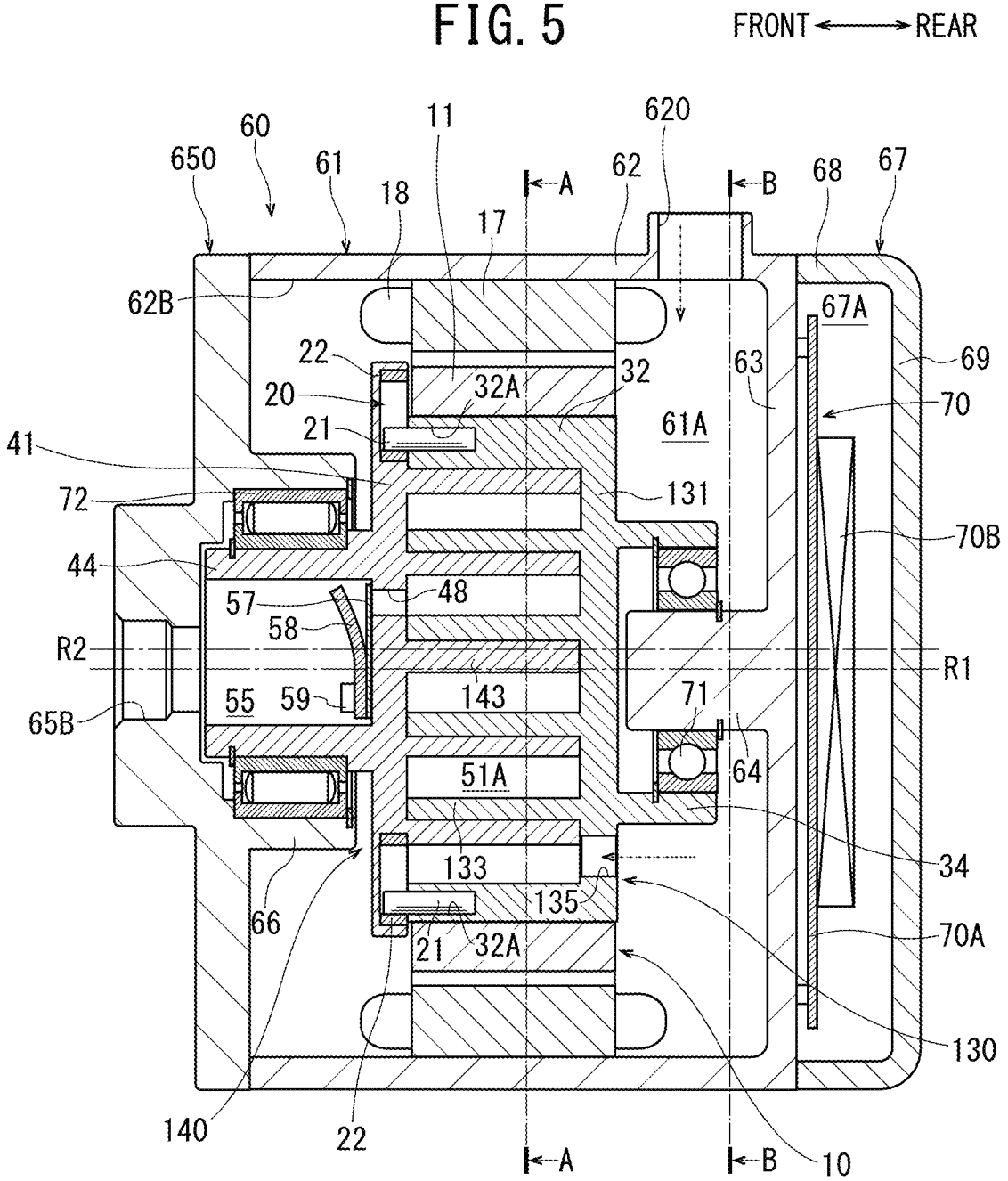
FIG. 5 is a sectional view of a co-rotating scroll compressor of embodiment 3.

As shown in FIG. 5, in a compressor of embodiment 3, a housing 60 is formed of a housing body 61, a cover 650, and an inverter case 67. Furthermore, this compressor includes a driving scroll 130 and a driven scroll 140.

The cover 650 is fastened to a first outer circumferential wall 62 of the housing body 61 by a bolt not shown similarly to the cover 65 in the compressor of embodiment 1. Furthermore, in the cover 650, a bearing support 66 and a discharge communication port 65B are also formed as in the cover 65. Here, in this compressor, an inlet communication port 620 is formed in the first outer circumferential wall 62, while the inlet communication port 65A is not formed for the cover 650.

The inlet communication port 620 extends through the first outer circumferential wall 62 in a radial direction of the housing body 61. Accordingly, the inlet communication port 620 also connects a suction chamber 61A to an outside of the compressor. Here, the inlet communication port 620 is disposed at a rear in the first outer circumferential wall 62, that is, in a position closer to the first bottom wall 63 than the cover 650 in the first outer circumferential wall 62. Furthermore, piping (not shown) is also connected to the inlet communication port 620. Thus, in this compressor, refrigerant gas is also suctioned into the suction chamber 61A.

The driving scroll 130 has a driving end plate 131, and a driving spiral body 133, and in addition, has a driving circumferential wall 32 similarly to the driving scroll 30. Similarly to the driving end plate 31, the driving end plate 131 also extends in a substantially disk shape orthogonally to a drive shaft center axis R1. Furthermore, as in the driving end plate 31, a driving circumferential wall 32 is formed integrally with an outer peripheral edge of the driving end plate 131. Furthermore, a first boss 34 is formed at a center of a rear surface of the driving end plate 131.

Figure 8:
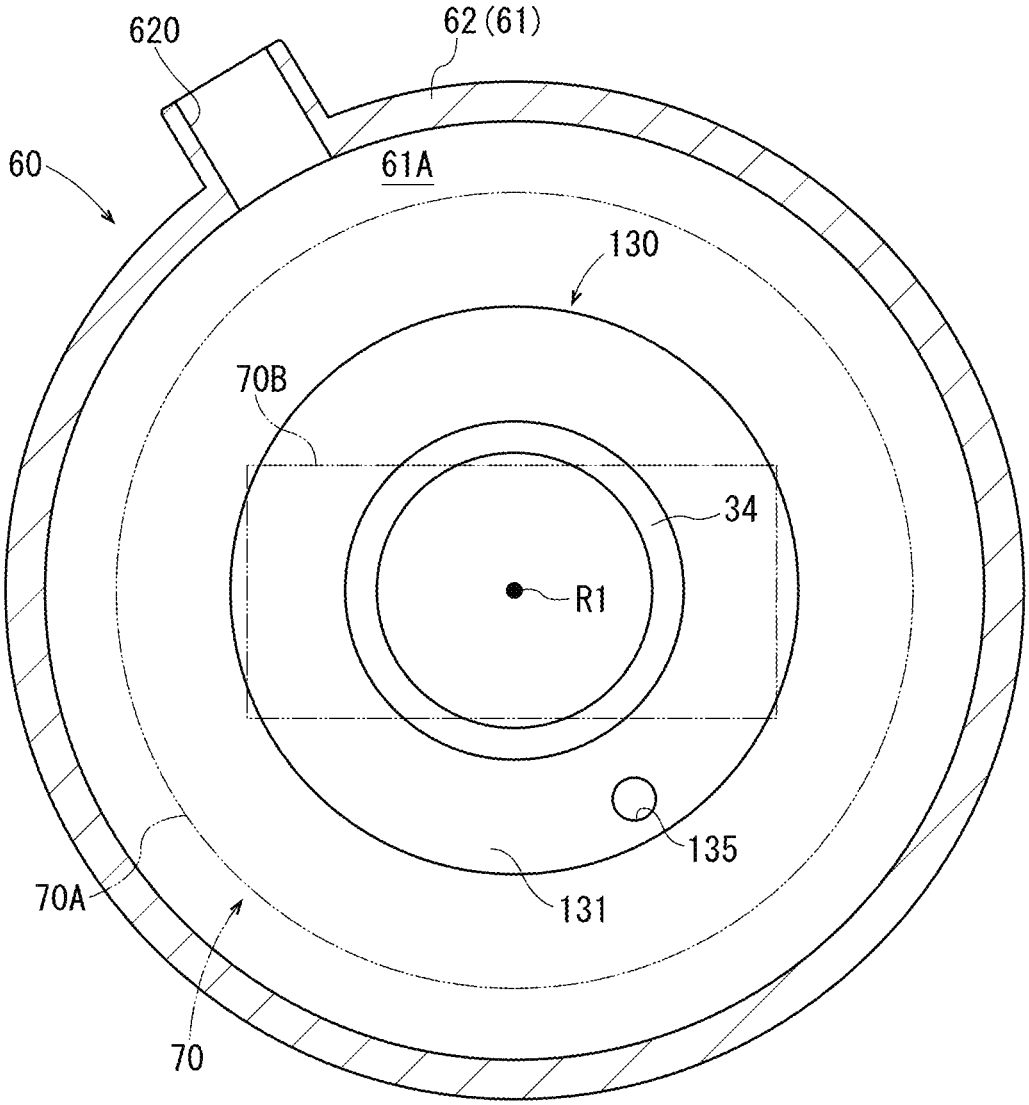
FIG. 8 is a sectional view illustrating a B-B section in FIG. 5 according to the co-rotating scroll compressor of embodiment 3.

Furthermore, in the driving end plate 131, a suction port 135 is formed. As shown in FIG. 8, the suction port 135 is positioned closer to an outer periphery than the first boss 34. The suction port 135 forms a circular shape and extends through the driving end plate 131 in a front-rear direction. Note that the suction port 135 may be formed into a substantially elliptical shape extending in a circumferential direction of the driving end plate 131.

Figure 6:
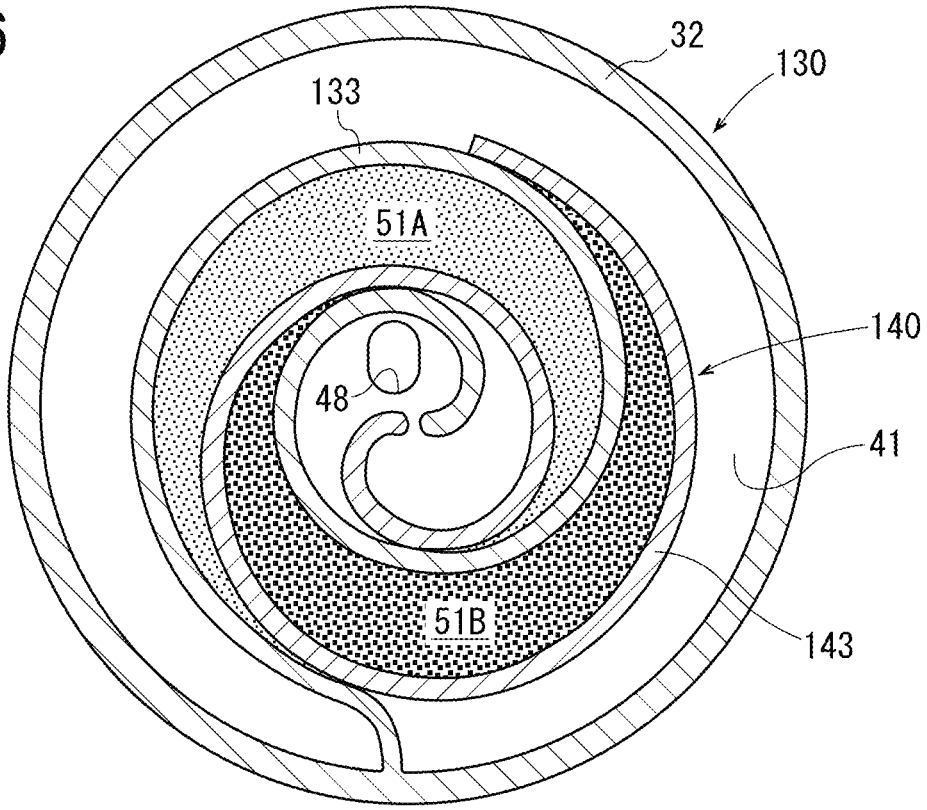
FIG. 6 is a sectional view illustrating an A-A section in FIG. 5 according to the co-rotating scroll compressor of embodiment 3.

As shown in FIG. 6, the driving spiral body 133 is located inside of the driving circumferential wall 32. The driving spiral body 133 extends frontward from the driving end plate 131 parallelly to the drive shaft center axis R1. The driving spiral body 133 extends in a spiral shape around the drive shaft center axis R1 toward the outer periphery from a spiral center while having the spiral center close to a center of the driving end plate 131. The driving spiral body 133 is connected to the driving circumferential wall 32 at an end portion close to an outer periphery in the spiral.

As shown in FIG. 5, the driven scroll 140 has a driven spiral body 143, and in addition, has a driven end plate 41 similarly to the driven scroll 40. The driven spiral body 143 extends rearward from the driven end plate 41 parallelly to a driven shaft center axis R2. As shown in FIG. 6, the driven spiral body 143 extends in a spiral shape around the driven shaft center axis R2 toward the outer periphery from a spiral center while having the spiral center close to a center of the driven end plate 41. Here, in this compressor, the number of turns in a circumferential direction in the driving spiral body 133, and the number of turns in the circumferential direction in the driven spiral body 143 are equal.

As shown in FIG. 5, both the driving scroll 130 and the driven scroll 140 are disposed in the suction chamber 61A. Furthermore, the driving scroll 130 is integrated with a rotor 11 by the driving circumferential wall 32 being fixed to an inner peripheral surface of the rotor 11, similarly to the driving scroll 30. In this compressor, the driving scroll 130 and the driven scroll 140 are assembled in the front-rear direction, and thereby the suction port 135 is located rearward in the suction chamber 61A. Thus, the suction port 135 faces the first bottom wall 63. Furthermore, the driving scroll 130 and the driven scroll 140 are assembled in the front-rear direction, and thereby the driving spiral body 133 and the driven spiral body 143 are meshed with each other inside of the driving circumferential wall 32. The other components in this compressor are the same as those in the compressor of embodiment 1.

In this compressor, the driving scroll 130 is driven rotatably, and the driven scroll 140 follows rotatably, whereby the driving spiral body 133 and the driven spiral body 143 contact each other. Accordingly, as shown in FIG. 6, the driving spiral body 133 and the driven spiral body 143 form a first compression chamber 51A and a second compression chamber 51B between them. With the rotational driving of the driving scroll 130 and the rotational following of the driven scroll 140, the driving spiral body 133 and the driven spiral body 143 change volumes of the first and second compression chambers 51A and 51B. Furthermore, with the rotational driving of the driving scroll 130, the suction port 135 allows the first and second compression chambers 51A and 51B to suction the refrigerant gas from the suction chamber 61A while rotating around the drive shaft center axis R1.

Figure 7:
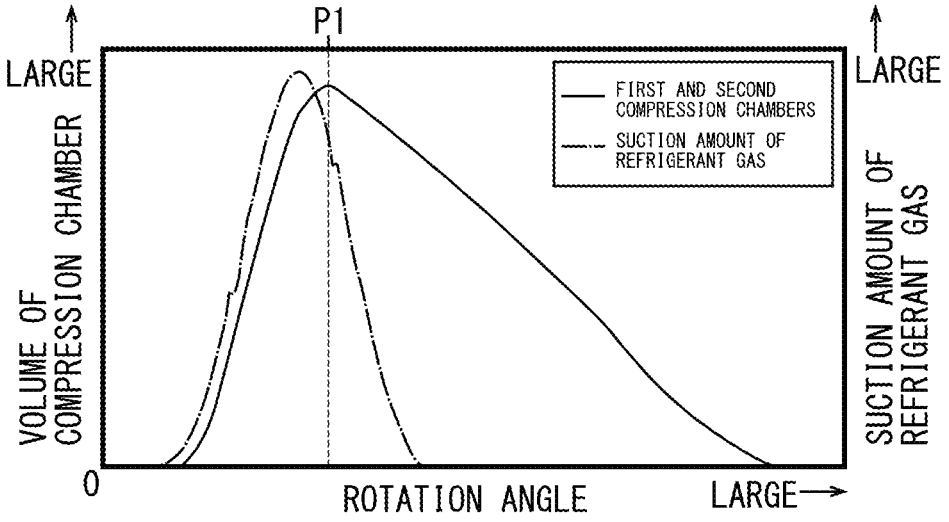
FIG. 7 is a graph showing a relationship of change in a volume of a first compression chamber and a second compression chamber and change in a suction amount of refrigerant gas according to the co-rotating scroll compressor of embodiment 3.

Here, in this compressor, the number of turns in the circumferential direction in the driving spiral body 133, and the number of turns in the circumferential direction in the driven spiral body 143 are equal. Consequently, as shown in FIG. 7, the first compression chamber 51A and the second compression chamber 51B are formed at same timing, and the volumes decrease from a maximum to a minimum after increasing to the maximum from the minimum at the same timing. Accordingly, in this compressor, when a phase of the driving scroll 130 being driven rotatably and the driven scroll 140 following the driving scroll 130 rotatably is a first phase P1, the volumes of the first and second compression chambers 51A and 51B are maximum.

Furthermore, as the volumes of the first and second compression chambers 51A and 51B increase, a flow rate of the refrigerant gas suctioned into the first and second compression chambers 51A and 51B from the suction port 135 increases. Consequently, when the volumes of the first and second compression chambers 51A and 51B are maximum, that is, when a phase of the driving scroll 130 and the driven scroll 140 is the first phase Pl, a flow rate of the refrigerant gas suctioned into the suction port 135 from the suction chamber 61A, in turn, a flow rate of the refrigerant gas suctioned into the first and second compression chambers 51A and 51B from the suction port 135 is in a large state. More precisely, in this compressor, immediately before the volumes of the first and second compression chambers 51A and 51B become maximum, the flow rate of the refrigerant gas suctioned into the suction port 135 from the suction chamber 61A becomes maximum. In this compressor, when the volumes of the first and second compression chambers 51A and 51B become maximum, the refrigerant gas is confined in the first and second compression chambers 51A and 51B by the driving end plate 131, the driving spiral body 133, the driven end plate 41 and the driven spiral body 143. In other words, when the phase of the driving scroll 130 and the driven scroll 140 is the first phase P1, the refrigerant gas is confined in the first and second compression chambers 51A and 51B.

As shown in FIG. 8, in this compressor, when the phase of the driving scroll 130 and the driven scroll 140 is the first phase P1, the suction port 135 is located on an opposite side of the inlet communication port 620 in the radial direction of the driving scroll 130 across the switching element 70B, in the suction chamber 61A. In other words, the suction port 135 is formed at a position on the opposite side of the inlet communication port 620 in the radial direction of the driving scroll 130 across the switching element 70B in the suction chamber 61A at the time of the first phase P1, in the driving end plate 131. Note that in FIG. 8, to facilitate explanation, the inverter circuit 70 including the switching element 70B is shown by a virtual line, while illustration of an electric motor 10, a bearing support 64 and the like is omitted. The same applies to FIG. 11 described later.

Consequently, in this compressor, when the phase of the driving scroll 130 and the driven scroll 140 is the first phase P1, the suction port 135 and the inlet communication port 620 are sufficiently away from each other in the radial direction of the driving scroll 130 in the suction chamber 61A. The suction port 135 suctions the refrigerant gas from the suction chamber 61A while rotating around the drive shaft center axis R1. At this time, as described above, in the first phase P1, a lot of refrigerant gas is suctioned into the suction port 135. Accordingly, in this compressor, the first bottom wall 63 including the position facing the switching element 70B is entirely cooled more uniformly and sufficiently by the refrigerant gas suctioned into the suction port 135. As a result of this, in this compressor, the inverter circuit 70 in the inverter chamber 67A including the switching element 70B can be suitably cooled through the first bottom wall 63 having a low temperature. The other operations in this compressor are the same as those in the compressor of embodiment 1.

Embodiment 4

Figure 9:
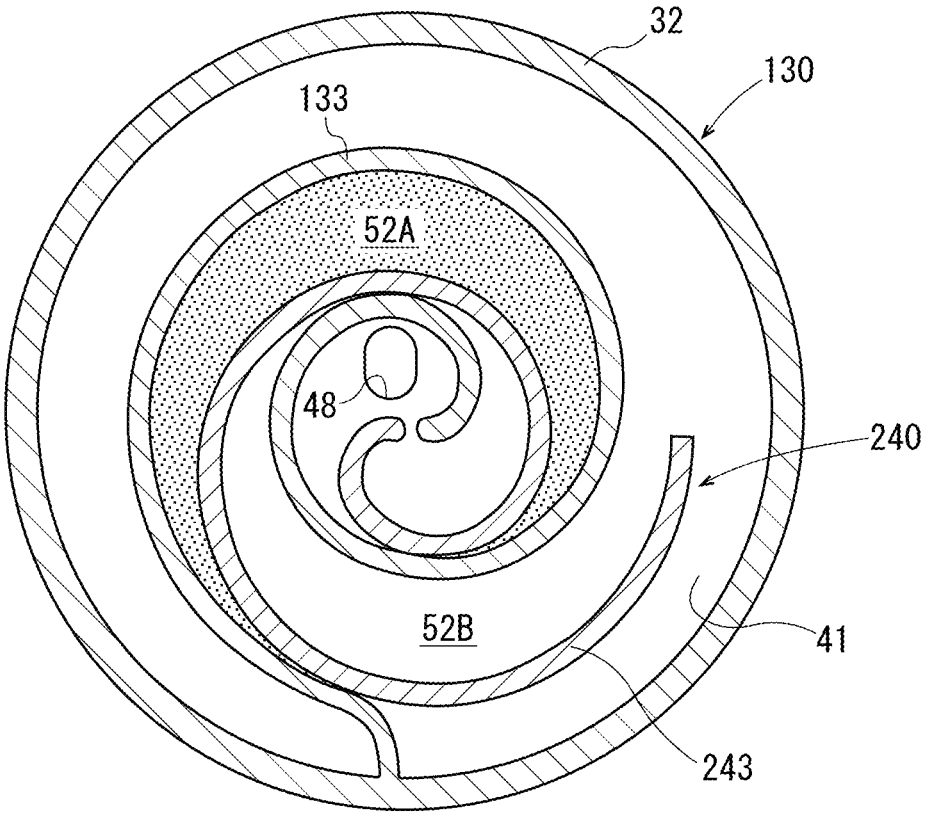
FIG. 9 is a sectional view similar to FIG. 5 according to a co-rotating scroll compressor of embodiment 4.

A compressor of embodiment 4 includes a driven scroll 240 shown in FIG. 9 in place of the driven scroll 140 in the compressor of embodiment 3. The driven scroll 240 has a driven spiral body 243, and in addition, has a driven end plate 41 similarly to the driven scrolls 40 and 140. The driven spiral body 243 extends rearward from the driven end plate 41 parallelly to a driven shaft center axis R2, similarly to the driven spiral bodies 43 and 143. Furthermore, the driven spiral body 243 extends in a spiral shape around the driven shaft center axis R2 toward an outer periphery from a spiral center, while having the spiral center close to a center of the driven end plate 41. Here, in this compressor, the number of turns in a circumferential direction in a driving spiral body 133, and the number of turns in the circumferential direction in the driven spiral body 243 are different. More specifically, in this compressor, the number of turns in the circumferential direction in the driven spiral body 243 is smaller as compared with the number of turns in the circumferential direction in the driving spiral body 133.

Figure 11:
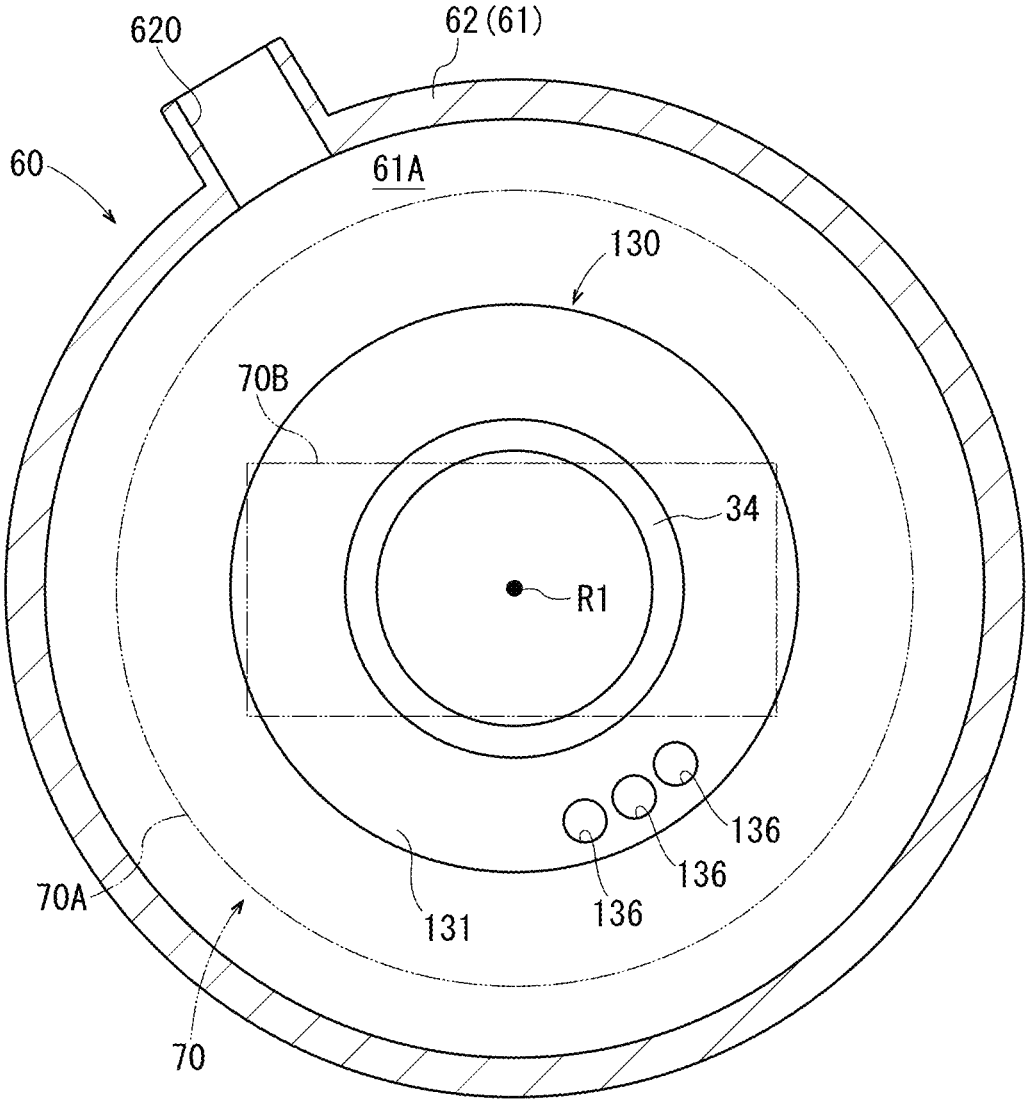
FIG. 11 is a sectional view similar to FIG. 8 according to the co-rotating scroll compressor of embodiment 4.

Furthermore, as shown in FIG. 11, in this compressor, three suction ports 136 are formed for a driving end plate 131 of a driving scroll 130. The respective suction ports 136 are disposed at positions closer to the outer periphery than a first boss 34. The respective suction ports 136 each also form a circular shape similarly to the suction port 135 in the compressor of embodiment 3 and extend through the driving end plate 131 in a front-rear direction. Furthermore, the respective suction ports 136 are disposed by being aligned in the circumferential direction of the driving end plate 131. Note that the number of the suction ports 136 can be appropriately designed, and, for example, only one of the suction ports 136 may be formed for the driving end plate 131. The other components in this compressor are the same as those in the compressor of embodiment 3.

Although detailed illustration is omitted, in this compressor, the driving scroll 130 and the driven scroll 240 are also assembled in the front-rear direction, and thereby the respective suction ports 136 are also located rearward in a suction chamber 61A to face a first bottom wall 63. Furthermore, as shown in FIG. 9, the driving scroll 130 is driven rotatably and the driven scroll 240 follows rotatably, whereby the driving spiral body 133 and the driven spiral body 243 form a first compression chamber 52A and a second compression chamber 52B. Then, the driving spiral body 133 and the driven spiral body 243 change volumes of the first compression chamber 52A and the second compression chamber 52B with the rotational driving of the driving scroll 130 and the rotational following of the driven scroll 240. Furthermore, the respective suction ports 136 allows the first and second compression chambers 52A and 52B to suction refrigerant gas from the suction chamber 61A while rotating around a drive shaft center axis R1.

Here, since the number of turns in the circumferential direction in the driving spiral body 133 and the number of turns in the circumferential direction in the driven spiral body 243 are different in this compressor, a lag occurs between timing at which the first compression chamber 52A is formed and timing at which the second compression chamber 52B is formed. As a result of this, in this compressor, a lag occurs between timing at which the volume of the first compression chamber 52A becomes maximum and confinement of the refrigerant gas occurs in the first compression chamber 52A, and timing at which the volume of the second compression chamber 52B becomes maximum and confinement of the refrigerant gas occurs in the second compression chamber 52B.

Figure 10:
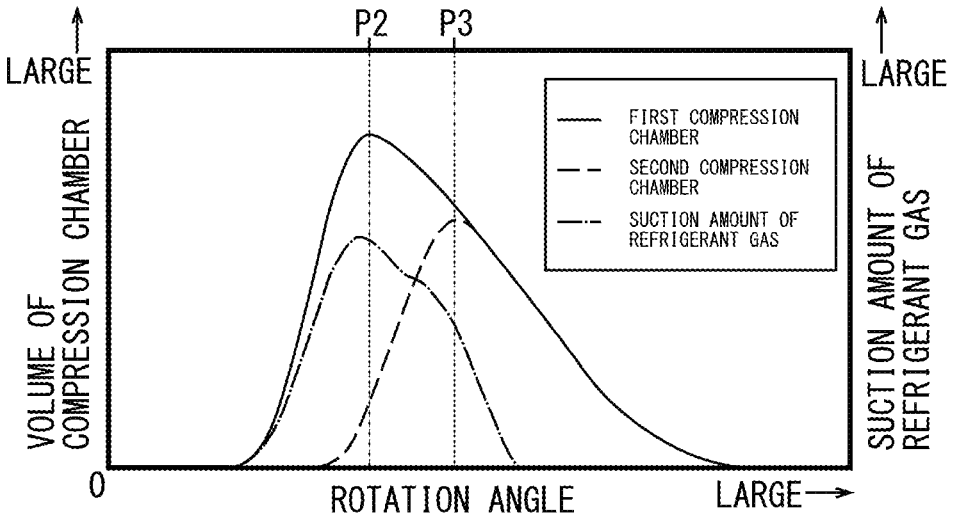
FIG. 10 is a graph showing a relationship of change in volumes of the first compression chamber and the second compression chamber and change in a suction amount of refrigerant gas according to the co-rotating scroll compressor of embodiment 4.

In other words, as shown in FIG. 10, in this compressor, when a phase of the driving scroll 130 and the driven scroll 240 following rotatably is a second phase P2, the volume of the first compression chamber 52A becomes maximum, and confinement of the refrigerant gas occurs in the first compression chamber 52A, but confinement of the refrigerant gas in the second compression chamber 52B does not occur in the second phase P2. In this compressor, when the phase of the driving scroll 130 and the driven scroll 240 following rotatably is a third phase that is more advanced than the second phase P2, the volume of the second compression chamber 52B becomes maximum, and confinement of the refrigerant gas occurs in the second compression chamber 52B. Note that in the third phase, the volume of the first compression chamber 52A is reduced from the maximum, and compression of the refrigerant gas progresses in the first compression chamber 52A.

Thus, in this compressor, as the volume of the first compression chamber 52A increases, a flow rate of the refrigerant gas suctioned into the respective suction ports 136 from the suction chamber 61A increases. Although confinement of the refrigerant gas in the first compression chamber 52A occurs in the second phase P2, confinement of the refrigerant gas in the second compression chamber 52B does not occur until the phase becomes the third phase P3 and therefore, the refrigerant gas in the suction chamber 61A continues to be suctioned into the respective suction ports 136 even after the phase passes the second phase P2. As a result of this, when the phase of the driving scroll 130 and the driven scroll 240 is between the second phase P2 and the third phase P3, this compressor is brought into a state where the flow rate of the refrigerant gas suctioned into the respective suction ports 136 from the suction chamber 61A is large.

As shown in FIG. 11, when the phase of the driving scroll 130 and the driven scroll 240 is from the second phase P2 to the third phase P3 in this compressor, the respective suction ports 136 are located on the opposite side to the inlet communication port 620 in the radial direction of the driving scroll 130 across the switching element 70B in the suction chamber 61A. In other words, the respective suction ports 136 are formed at positions that are on the opposite side to the inlet communication port 620 in the radial direction of the driving scroll 130 across the switching element 70B, in the suction chamber 61A between the second phase P2 and the third phase P3, in the driving end plate 131.

Consequently, in this compressor, the respective suction ports 136 and the inlet communication port 620 are sufficiently away from each other in the radial direction of the driving scroll 130 in the suction chamber 61A while the phase of the driving scroll 130 and the driven scroll 240 is from the second phase P2 to the third phase P3. Then, the respective suction ports 136 suction the refrigerant gas from the suction chamber 61A while rotating around the drive shaft center axis R1. At this time, as described above, a lot of refrigerant gas is suctioned into the respective suction ports 136 between the second phase P2 and the third phase P3. Thus, this compressor can also exhibit the same operations as those of the compressors of embodiments 1 and 3.

Although the present disclosure has been described above in line with embodiments 1 to 4, it is needless to say that the present disclosure is not limited to the above-described embodiments 1 to 4, but the above-described embodiments may be appropriately modified in application without departing from the gist of the present disclosure.

For example, in the compressor of embodiment 1, the suction port 47 is formed in the driving end plate 31 of the driving scroll 30, and the driving end plate 31 and the suction port 47 are faced to the first bottom wall 63, in the suction chamber 61A. However, regardless of this, a configuration may be adopted, in which the suction port 47 is formed in the driven end plate 41 of the driven scroll 40, and the driven end plate 41 and the suction port 47 are faced to the first bottom wall 63 in the suction chamber 61A. In this case, the driven end plate 41 may have the respective guide blades 92 of embodiment 2. The same applies to the compressors of embodiments 2 to 4.

Furthermore, in the compressor of embodiment 1, an auxiliary suction port that faces the cover 65 may be formed for the driven end plate 41. In this case, the refrigerant gas in the suction chamber 61A is not only suctioned into the compression chamber 50 from the suction port 47 while being stirred between the first bottom wall 63 and the driving end plate 31 but also suctioned into the compression chamber 50 from the auxiliary suction port while also being stirred between the cover 65 and the driven end plate 41. Accordingly, variation in the temperature distribution in the suction chamber 61A can be further reduced. The same applies to the compressors of embodiments 2 to 4.

Furthermore, in the compressors of embodiments 1 and 2, the inlet communication port 65A may be disposed at a position closer to the driving end plate 31 than the driven end plate 41, by forming the inlet communication port 65A in a rear portion of the first outer circumferential wall 62.

Furthermore, in the compressor of embodiment 1, a cover member facing the first bottom wall 63 may be attached to the driving end plate 31, a communication port that communicates with the suction port 47 may be formed in the cover member, and by the suction port 47 and the communication port, the "suction port" in the present disclosure may be formed. The same applies to the compressors of embodiments 3 and 4.

Furthermore, in the compressor of embodiment 2, a cover member facing the first bottom wall 63 may be attached to the driving end plate 91, communication ports that communicate with the respective suction ports 49 may be formed in the cover member, and by the respective suction ports 49 and communication ports, the "suction port" in the present disclosure may be formed. Furthermore, in this case, the respective guide blades 92 may be formed at the cover member.

Furthermore, in the compressor of embodiment 3, the one suction port 135 is formed for the driving end plate 131. However, regardless of this, a plurality of suction ports 135 may be formed for the driving end plate 131. In this case, when the phase of the driving scroll 130 and the driven scroll 140 is the first phase P1, the respective suction ports 135 can be located on the opposite side of the inlet communication port 620 in the radial direction of the driving scroll 130 across the switching element 70B, in the suction chamber 61A.

Furthermore, in the compressors of embodiments 1 to 4, the driven mechanism 20 is formed of the rotation prevention pin 21 and the ring 22. However, regardless of this, the driven mechanism 20 may be configured by a pin-ring-pin method in which two pins slide in contact with an inner peripheral surface of one free ring, a pin-pin method in which outer peripheral surfaces of two pins slide in contact with each other, a method using an Oldham coupling, or the like.

Furthermore, in the compressor of embodiment 1, the driving scroll 30 and the rotor 11 are integrated, by fixing the driving circumferential wall 32 to the inner peripheral surface of the rotor 11. However, regardless of this, a configuration may be adopted, in which the driving scroll 30 and the rotor 11 are disposed away from each other in the direction of the drive shaft center axis R1 by connecting the driving scroll 30 and the rotor 11 so as to be able to transmit power by the drive shaft. The same applies to the compressors of embodiments 2 to 4.

Furthermore, in the compressors of embodiments 1 to 4, refrigerant gas is cited as a "fluid" in the present disclosure, but regardless of this, the fluid may be air or the like that is supplied to a fuel battery.

INDUSTRIAL APPLICABILITY

The present disclosure is applicable to an air-conditioning apparatus for a vehicle and the like.

REFERENCE SIGNS LIST

10 electric motor (driving mechanism)
11 rotor
17 stator
20 driven mechanism
30, 90, 130 driving scroll
31, 91, 131 driving end plate
33, 133 driving spiral body
40, 140, 240 driven scroll
41 driven end plate
43, 143, 243 driven spiral body
47, 49, 135, 136 suction port
50 compression chamber
51A, 52A first compression chamber
51B, 52B second compression chamber
60 housing
63 first bottom wall (partition wall)
65A, 620 inlet communication port
67A inverter chamber
70 inverter circuit
70B switching element
92 guide blade (guide portion)
P1 first phase
P2 second phase
P3 third phase
R1 drive shaft center axis
R2 driven shaft center axis

The invention claimed is:

1. A co-rotating scroll compressor comprising a driving mechanism, an inverter circuit, a driving scroll, a driven mechanism, a driven scroll, and a housing, the housing having a suction chamber into which a fluid is suctioned from an outside, an inverter chamber in which the inverter circuit is accommodated, and a partition wall that separates the suction chamber and the inverter chamber from each other, the driving scroll being disposed in the suction chamber and being rotationally driven around a drive shaft center axis by the driving mechanism, the driven scroll being disposed in the suction chamber and rotationally following around a driven shaft center axis that is eccentric with respect to the driving scroll by the driving scroll and the driven mechanism, the driving scroll having a driving end plate extending to cross the drive shaft center axis, and a driving spiral body protruding toward the driven scroll from the driving end plate and forming a spiral shape, the driven scroll having a driven end plate extending to cross the driven shaft center axis, and a driven spiral body protruding toward the driving scroll from the driven end plate and forming a spiral shape, and the driving scroll and the driven scroll forming a compression chamber by the driving spiral body and the driven spiral body facing each other, and reducing a volume of the compression chamber by the rotational driving and the rotational following, wherein a suction port that allows the compression chamber to suction the fluid from the suction chamber is formed in one of the driving end plate and the driven end plate, the suction port faces the partition wall, and a discharge port that discharges the fluid from the compression chamber to the outside is formed in the other of the driving end plate and the driven end plate.

2. The co-rotating scroll compressor according to claim 1, wherein the driving mechanism is disposed in the suction chamber, the housing has an inlet communication port that connects the outside to the suction chamber, the suction port is formed in the driving end plate, and the inlet communication port is further away from the driving end plate than the driven end plate.

3. The co-rotating scroll compressor according to claim 2, wherein the driving end plate has a guide portion that guides the fluid to the suction port while stirring the fluid.

4. The co-rotating scroll compressor according to claim 1, wherein the inverter circuit has a switching element, the suction port is a plurality of suction ports, and the respective suction ports sequentially overlap the switching element in an axial direction of the drive shaft via the partition wall, with the rotational driving of the driving scroll and the rotational following of the driven scroll.

5. The co-rotating scroll compressor according to claim 1, wherein the housing has an inlet communication port that connects the outside to the suction chamber, the inverter circuit has a switching element, the compression chamber has a first compression chamber, and a second compression chamber separated from the first compression chamber, the number of turns in a circumferential direction in the driving spiral body, and the number of turns in the circumferential direction in the driven spiral body are equal, a phase of the driving scroll and the driven scroll in which respective volumes of the first compression chamber and the second compression chamber become maximum is a first phase, and the suction port is located on an opposite side of the inlet communication port in a radial direction across the switching element, in the first phase.

6. The co-rotating scroll compressor according to claim 1, wherein the housing has an inlet communication port that connects the outside to the suction chamber, the inverter circuit has a switching element, the compression chamber has a first compression chamber, and a second compression chamber separated from the first compression chamber, the number of turns in the circumferential direction in the driving spiral body, and the number of turns in the circumferential direction in the driven spiral body are different, a phase of the driving scroll and the driven scroll in which a volume of the first compression chamber becomes maximum is a second phase, a phase of the driving scroll and the driven scroll in which a volume of the second compression chamber becomes maximum is a third phase, and the suction port is located on an opposite side of the inlet communication port in a radial direction across the switching element, between the second phase and the third phase.

7. The co-rotating scroll compressor according to claim 1, wherein a discharge chamber, which discharges the fluid to the outside, is formed between the housing and the other of the driving end plate and the driven end plate, and the discharge chamber communicates with the discharge port.

* * * * *